US005783517A

United States Patent [19]

Tomita et al.

[11] Patent Number: 5,783,517

[45] Date of Patent: Jul. 21, 1998

[54] PRINTING PAPER FOR THERMAL TRANSFER

[75] Inventors: Hidemi Tomita, Tokyo; Huy Sam, Miyagi; Miyuki Kuromiya, Kanagawa; Seiichi Yamamoto, Saitama; Masataka Mizoguchi, Chiba, all of Japan

[73] Assignees: Sony Corporation; Fujikura Kasei Co., Ltd., both of Tokyo, Japan

[21] Appl. No.: 603,878

[22] Filed: Feb. 22, 1996

[51] Int. Cl.[6] ..... B41M 5/035; B41M 5/38

[52] U.S. Cl. ..... 503/227; 428/195; 428/913; 428/914

[58] Field of Search ..... 8/471; 428/195, 428/411.1, 500, 913, 914; 503/227

[56] References Cited

U.S. PATENT DOCUMENTS 5,064,717 11/1991 Suzuki et al. ..... 428/352
5,348,991 9/1994 Yoshikawa et al. ..... 523/402
5,439,998 8/1995 Lina et al. ..... 526/243

FOREIGN PATENT DOCUMENTS

A-367109 9/1990 European Pat. Off. ..... 503/227

*Primary Examiner*—Bruce H. Hess
*Attorney, Agent, or Firm*—Hill & Simpson

[57] ABSTRACT

A printing paper for use in sublimation-type thermal transfer recording includes a sheet-like base and a dye receiving layer disposed thereon. The dye receiving layer is composed of a copolymer of substituted or unsubstituted phenoxypolyethylene glycol acrylate or substituted or unsubstituted phenoxypolyethylene glycol methacrylate and another monomer. The substituted or unsubstituted phenoxypolyethylene glycol acrylate or the substituted or unsubstituted phenoxypolyethylene glycol methacrylate is of a proportion of at least 50 weight % of the copolymer.

7 Claims, 5 Drawing Sheets

FIG. 2

| COPOLYMER CONSTITUENTS (WT %) | CO. EX. 1 | IN. EX. 1 | IN. EX. 2 | IN. EX. 3 | IN. EX. 4 | CO. EX. 2 | IN. EX. 5 | IN. EX. 6 | IN. EX. 7 | IN. EX. 8 |
|---|---|---|---|---|---|---|---|---|---|---|
| (PHENOXYPOLYETHYLENE GLYCOL METHACRYLATE) | | | | | | | | | | |
| PHENOXYETHYL METHACRYLATE | 100 | 95 | 90 | 80 | 60 | 40 | 95 | 90 | 95 | 90 |
| PHENOXYETHOXYETHYL METHACRYLATE | — | — | — | — | — | — | — | — | — | — |
| (OTHER MONOMERS) | | | | | | | | | | |
| STYRENE | — | 5 | 10 | 20 | 40 | 60 | — | — | — | — |
| METHYL METHACRYLATE | — | — | — | — | — | — | 5 | 10 | — | — |
| PHENYL METHACRYLATE | — | — | — | — | — | — | — | — | 5 | 10 |
| CYCLOHEXYL METHACRYLATE | — | — | — | — | — | — | — | — | — | — |
| ISOBORNYL METHACRYLATE | — | — | — | — | — | — | — | — | — | — |
| VINYL BENZOATE | — | — | — | — | — | — | — | — | — | — |
| HYDROXYETHYL METHACRYLATE | — | — | — | — | — | — | — | — | — | — |
| EVALUATIONS | | | | | | | | | | |
| GLASS TRANSITION TEMPERATURE Tg (°C) | 45 | 48 | 52 | 59 | 71 | 82 | 49 | 53 | 51 | 55 |
| BLOCKING TENDENCY | C | B | A | A | A | A | B | A | B | A |
| TRANSFER SENSITIVITY (Y) | ○ | ○ | ○ | △ | △ | × | ○ | ○ | ○ | ○ |
| DITTO (M) | ◎ | ◎ | ○ | ○ | △ | × | ◎ | ◎ | ◎ | ◎ |
| DITTO (C) | ○ | ○ | ○ | ○ | △ | × | ○ | ○ | ○ | ○ |
| LIGHT RESISTANCE (Y) | ◎ | ◎ | ○ | ○ | △ | × | ◎ | ○ | ◎ | ○ |
| DITTO (M) | ○ | ○ | ○ | ○ | △ | × | ○ | ○ | ○ | ○ |
| DITTO (C) | ○ | ◎ | ○ | ○ | △ | △ | ○ | ○ | ○ | ○ |
| SEBUM RESISTANCE | ◎ | ◎ | ◎ | ◎ | ○ | △ | ◎ | ◎ | ◎ | ◎ |

FIG. 3

| COPOLYMER CONSTITUENTS (WT %) | IN. EX. 9 | 10 | 11 | 12 | 13 | 14 |
|---|---|---|---|---|---|---|
| (PHENOXYPOLYETHYLENE GLYCOL METHACRYLATE) | | | | | | |
| PHENOXYETHYL METHACRYLATE | 95 | 90 | 95 | 90 | 90 | 80 |
| PHENOXYETHOXYETHYL METHACRYLATE | — | — | — | — | — | — |
| (OTHER MONOMERS) | | | | | | |
| STYRENE | — | — | — | — | — | — |
| METHYL METHACRYLATE | — | — | — | — | — | — |
| PHENYL METHACRYLATE | — | — | — | — | — | — |
| CYCLOHEXYL METHACRYLATE | 5 | 10 | — | — | — | — |
| ISOBORNYL METHACRYLATE | — | — | 5 | 10 | — | — |
| VINYL BENZOATE | — | — | — | — | 10 | 20 |
| HYDROXYETHYL METHACRYLATE | — | — | — | — | — | — |
| EVALUATIONS | | | | | | |
| GLASS TRANSITION TEMPERATURE Tg (°C) | 50 | 55 | 51 | 55 | 48 | 53 |
| BLOCKING TENDENCY | B | A | B | A | B | A |
| TRANSFER SENSITIVITY (Y) | ○ | ○ | ○ | ○ | ○ | ○ |
| DITTO (M) | ◎ | ◎ | ◎ | ◎ | ◎ | ○ |
| DITTO (C) | ○ | ○ | ○ | ○ | ○ | ○ |
| LIGHT RESISTANCE (Y) | ◎ | ◎ | ◎ | ○ | ◎ | ○ |
| DITTO (M) | ○ | ○ | ○ | ○ | ◎ | ◎ |
| DITTO (C) | ○ | ○ | ○ | ○ | ○ | ○ |
| SEBUM RESISTANCE | ◎ | ◎ | ◎ | ◎ | ◎ | ○ |

FIG. 4

| COPOLYMER CONSTITUENTS (WT %) | IN. EX. 15 | 16 | 17 | 18 | 19 | 20 | 21 | 22 |
|---|---|---|---|---|---|---|---|---|
| (PHENOXYPOLYETHYLENE GLYCOL METHACRYLATE) | | | | | | | | |
| PHENOXYETHYE METHACRYLATE | 97 | 95 | 90 | 90 | 90 | 90 | 90 | 90 |
| PHENOXYETHOXYETHYL METHACRYLATE | — | — | — | — | — | — | — | — |
| (OTHER MONOMERS) | | | | | | | | |
| STYRENE | — | — | — | 5 | — | — | — | — |
| METHYL METHACRYLATE | — | — | — | — | 5 | — | — | — |
| PHENYL METHACRYLATE | — | — | — | — | — | 5 | — | — |
| CYCLOHEXYL METHACRYLATE | — | — | — | — | — | — | 5 | — |
| ISOBORNYL METHACRYLATE | — | — | — | — | — | — | — | 5 |
| VINYL BENZOATE | — | — | — | — | — | — | — | — |
| HYDROXYETHYL METHACRYLATE | 3 | 5 | 10 | 5 | 5 | 5 | 5 | 5 |
| EVALUATIONS | | | | | | | | |
| GLASS TRANSITION TEMPERATURE Tg (°C) | 46 | 49 | 52 | 52 | 53 | 53 | 52 | 54 |
| BLOCKING TENDENCY | B | B | A | A | A | A | A | A |
| TRANSFER SENSITIVITY (Y) | ◎ | ◎ | ◎ | ○ | ○ | ○ | ○ | ○ |
| DITTO (M) | ◎ | ◎ | ◎ | ◎ | ◎ | ◎ | ◎ | ◎ |
| DITTO (C) | ○ | ○ | ◎ | ◎ | ◎ | ◎ | ◎ | ◎ |
| LIGHT RESISTANCE (Y) | ◎ | ◎ | ○ | ◎ | ◎ | ◎ | ◎ | ◎ |
| DITTO (M) | ○ | ○ | ○ | ○ | ◎ | ○ | ○ | ○ |
| DITTO (C) | ○ | ○ | ○ | ○ | ○ | ◎ | ○ | ○ |
| SEBUM RESISTANCE | ◎ | ◎ | ◎ | ◎ | ◎ | ◎ | ◎ | ◎ |

FIG. 5

| COPOLYMER CONSTITUENTS (WT %) | IN. EX. 23 | 24 | 25 | 26 | 27 | 28 |
|---|---|---|---|---|---|---|
| (PHENOXYPOLYETHYLENE GLYCOL METHACRYLATE) | | | | | | |
| PHENOXYETHYL METHACRYLATE | 65 | 65 | 65 | 65 | 65 | 55 |
| PHENOXYETHOXYETHYL METHACRYLATE | 10 | 10 | 10 | 10 | 10 | 10 |
| (OTHER MONOMERS) | | | | | | |
| STYRENE | 20 | — | — | — | — | — |
| METHYL METHACRYLATE | — | 20 | — | — | — | — |
| PHENYL METHACRYLATE | — | — | 20 | — | — | — |
| CYCLOHEXYL METHACRYLATE | — | — | — | 20 | — | — |
| ISOBORNYL METHACRYLATE | — | — | — | — | 20 | — |
| VINYL BENZOATE | — | — | — | — | — | 30 |
| HYDROXYETHYL METHACRYLATE | 5 | 5 | 5 | 5 | 5 | 5 |
| EVALUATIONS | | | | | | |
| GLASS TRANSITION TEMPERATURE Tg (°C) | 56 | 57 | 58 | 56 | 57 | 55 |
| BLOCKING TENDENCY | A | A | A | A | A | A |
| TRANSFER SENSITIVITY (Y) | ◎ | ◎ | ○ | ◎ | ○ | ○ |
| DITTO (M) | ◎ | ◎ | ◎ | ○ | ○ | ○ |
| DITTO (C) | ○ | ○ | ◎ | ○ | ◎ | ○ |
| LIGHT RESISTANCE (Y) | ○ | ○ | ○ | ◎ | ○ | ○ |
| DITTO (M) | ○ | ○ | ○ | ○ | ○ | ○ |
| DITTO (C) | ○ | ◎ | ○ | ○ | ○ | ○ |
| SEBUM RESISTANCE | ◎ | ◎ | ◎ | ◎ | ◎ | ◎ |

PRINTING PAPER FOR THERMAL TRANSFER

BACKGROUND OF THE INVENTION

1. Field of the Invention

The present invention relates to a printing paper for use in sublimation-type thermal transfer recording, and more particularly to a printing paper having a dye receiving layer made of certain materials for increasing the image sensitivity thereof and also the image retaining abilities thereof including sebum resistance, plasticizer resistance, and light resistance.

2. Description of the Prior Art

There has been known a sublimation-type thermal transfer recording process for superimposing an ink ribbon having an ink layer made of a sublimation-type or thermal-diffusion-type dye and a printing paper having a dye receiving layer on each other, and heating the ink layer of the ink ribbon with a thermal head or the like in a pattern depending on image information to be recorded, for thereby transferring the dye from the ink layer to the dye receiving layer of the printing paper to form an image on the printing paper. Since the sublimation-type thermal transfer recording process is capable of forming full-color images of continuous gradation, it is finding wide use as a process of producing hardcopy of video images.

FIG. 1 of the accompanying drawings shows in cross section a general printing paper 1 for use in the sublimation-type thermal transfer recording process. As shown in FIG. 1, the printing paper 1 is of a laminated structure composed of a sheet-like base 2 and a dye receiving layer 3 disposed thereon. The dye receiving layer 3 serves to receive the dye that is transferred from the ink ribbon upon thermal transfer recording and hold an image which is formed by the received dye. The dye receiving layer 3 is made of an absorbable resin such as polyester, cellulose ester, polycarbonate, polyvinyl chloride, or the like.

In order that the printing paper shown in FIG. 1 can be used on high-speed printers, it is required in recent years to have the following properties:

(i) The printing paper should be highly sensitive and capable of being dyed, and should be capable of forming glossy clear images of high density.

(ii) The printing paper should be capable of stably retaining images formed thereon. Specifically, (a) the printing paper should be highly resistant to fingerprints and sebum. That is, when an image formed on the printing paper is brought into contact with part of a human body, such as a hand, a finger, etc., the dye of the image should not be agglomerated or faded. (b) The printing paper should be highly resistant to plasticizers. When an image formed on the printing paper contacts a plastic eraser containing a plasticizer or debris of such a plastic eraser, the dye of the image should not be agglomerated or faded. (c) The printing paper should be highly resistant to light so that an image formed thereon will not be faded or discolored when exposed to light. (d) The printing paper should also be highly resistant to shading and fading.

To meet the above requirements, various proposals have been made with respect to the structure of printing papers. For example, it has been proposed to use polyvinyl acetal as a major constituent of the dye receiving layer (see Japanese laid-open patent publication No. 4-10339).

The conventional printing paper whose dye receiving layer is made of an absorbable resin such as polyester is not sufficiently resistant to light, shading and fading, sebum, and plasticizers, and hence has a poor ability to retain images formed thereon. With regard to the printing paper whose dye receiving layer is primarily made of polyvinyl acetal, its ability to retain formed images is not sufficient and remains to be improved.

Prior attempts have been made to improve the ability to retain formed images by adding a retentivity improver such as an UV absorbent, an antioxidant, or the like to the dye receiving layer. However, those efforts have not been sufficiently satisfactory. It has also been attempted to laminate a cover film to a printing paper with an image formed thereon in order to improve the resistance to sebum and plasticizers. Laminating a cover film, however, requires a laminating step in addition to the step of forming an image through thermal transfer recording. The printing paper laminated by the cover film poses problems as to appearance and thickness.

OBJECTS AND SUMMARY OF THE INVENTION

It is therefore an object of the present invention to provide a printing paper which is highly sensitive and has excellent image retaining abilities including light resistance, shading and fading resistance, sebum resistance, and plasticizer resistance.

The inventor has found out that when a dye receiving layer of a printing paper is made of a copolymer of phenoxypolyethylene glycol acrylate or phenoxypolyethylene glycol methacrylate (both may be referred to as phenoxypolyethylene glycol (meth)acrylate) and another monomer having a structure different therefrom, with the phenoxypolyethylene glycol (meth)acrylate having a proportion of at least 50 weight %, the printing paper has increased sensitivity and also increased abilities to retain images formed thereon, and has made the present invention based on the above finding.

According to the present invention, there is provided a printing paper comprising a sheet-like base and a dye receiving layer disposed on the sheet-like base, the dye receiving layer being composed of a copolymer of substituted or unsubstituted phenoxypolyethylene glycol (meth) acrylate and another monomer, the substituted or unsubstituted phenoxypolyethylene glycol (meth)acrylate being of a proportion of at least 50 weight % of the copolymer.

BRIEF DESCRIPTION OF THE DRAWINGS

FIGS. 2 through 5 are Tables 2 through 5, respectively, showing copolymer constituents and evaluations of various comparative and inventive examples.

DETAILED DESCRIPTION OF THE PREFERRED EMBODIMENTS

Figure 1:
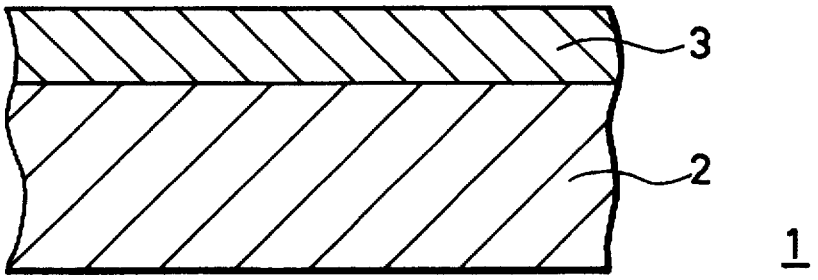
FIG. 1 is a fragmentary cross-sectional view of a general printing paper.

A printing paper according to the present invention is basically of a laminated structure composed of a sheet-like base and a dye receiving layer disposed thereon, as with the printing paper shown in FIG. 1. According to the present invention, the dye receiving layer is made of a copolymer of substituted or unsubstituted phenoxypolyethylene glycol (meth)acrylate and another monomer.

The substituted or unsubstituted phenoxypolyethylene glycol (meth)acrylate may be phenoxypolyethylene glycol acrylate represented by the following formula (1) or phenoxypolyethylene glycol methacrylate represented by the following formula (2), for example:

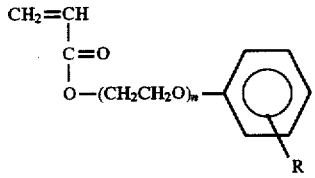

(1)

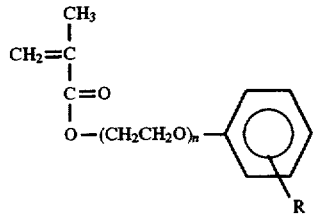

(2)

In the above formulas (1), (2), "n" should preferably be in the range from 1 to 3, and more preferably be 1.

The substituent in the formulas (1), (2) may be a substituting group R ($R=CH_3$, $C_2H_5$, or the like) introduced into the position o, m, or p in the phenoxy group.

With the polymer of substituted or unsubstituted phenoxypolyethylene glycol (meth)acrylate being used as a main constituent of the dye receiving layer, the sensitivity of the dye receiving layer is increased, and the image retaining abilities including light resistance, sebum resistance, etc. of images formed in the dye receiving layer are also increased. If substituted or unsubstituted phenoxypolyethylene glycol (meth)acrylate were singly polymerized, then when sheets of printing paper are superimposed and stored at a high temperature of about 50° C., the dye receiving layer of one sheet of printing paper would tend to stick to the reverse side of another sheet of printing paper superimposed thereon, resulting in blocking. To avoid such a drawback, the dye receiving layer of the printing paper according to the present invention is made of a copolymer of substituted or unsubstituted phenoxypolyethylene glycol (meth)acrylate and another monomer having a structure different from the structure of substituted or unsubstituted phenoxypolyethylene glycol (meth)acrylate.

The other monomer should preferably be of such a nature which makes the glass transition temperature Tg of the copolymer equal to or higher than 45° C., preferably 50° C., in order to prevent blocking.

If the glass transition temperature of the dye receiving layer were made too high by increasing the glass transition temperature of the copolymer, then the sensitivity of the printing paper would be lowered. However, as described later on, when an ester compound of low molecular weight used generally as a plasticizer is added, in addition to the copolymer, to the dye receiving layer, the glass transition temperature of the dye receiving layer is prevented from excessively increasing, and hence the sensitivity is also prevented from being lowered. Therefore, it is preferable to make the glass transition temperature of the copolymer equal to or higher than 45° C., as described above, in order to prevent blocking.

Monomers capable of controlling the glass transition temperature of the copolymer may be those monomers whose single polymer has a glass transition temperature of 55° C. or higher or those monomers which have a plurality of functional groups and serve as crosslinking components of copolymers. For example, such monomers include (i) methacrylate ester or acrylic ester (phenyl methacrylate, isobornyl methacrylate, cyclohexyl methacrylate, methyl methacrylate, ethyl methacrylate, aryl methacrylate, aminoethyl methacrylate, hydroxyethyl methacrylate, hydroxypropyl methacrylate, etc.), (ii) vinyl aromatic carboxylate (vinyl benzoate, vinyl chlorbenzoate, etc.), (iii) vinyl monomer (styrene, chlorostyrene, bromostyrene, acetoxystyrene, methoxystyrene, methylstyrene, epoxystyrene, vinyl phenol, etc.). These monomers may be used singly or in combination.

According to the present invention, the proportions of the constituents of the copolymer are selected such that the substituted or unsubstituted phenoxypolyethylene glycol (meth)acrylate is of a proportion of 50 weight % or greater, preferably in the range from 75 to 99 weight %. If the proportion of the substituted or unsubstituted phenoxypolyethylene glycol (meth)acrylate were too small, the sensitivity of the dye receiving layer and the image retaining ability thereof would not sufficiently be increased. Conversely, if the proportion of the substituted or unsubstituted phenoxypolyethylene glycol (meth)acrylate were too large, blocking would not be prevented.

The weight-average molecular weight of the copolymer should preferably be in the range from about 50,000 to 1,000,000. If the weight-average molecular weight were too large, then a solution containing the copolymer, which will be applied to coat the dye receiving layer, would be excessively viscous. If the weight-average molecular weight were too small, then coating characteristics of such a solution would be poor.

The copolymer may be manufactured by any of various processes such as suspension polymerization, bulk polymerization, solution polymerization, emulsion polymerization, etc.

The dye receiving layer of the printing paper according to the present invention may include, in addition of the copolymer described above, a compound for increasing absorption and image retaining ability. Such a compound may be any of various ester compounds generally used as a plasticizer, e.g., polyhydric phenol ester, polyhydric alcohol ester, phthalic ester, phosphoric ester, etc., or any of various resins, e.g., polyester, polycarbonate, polyacrylic ester, polyvinyl chloride, etc.

When such a compound or a resin is included, together with the copolymer, in the dye receiving layer, it is preferable that the copolymer have a 50 weight % or more of the dye receiving layer. If the proportion of the copolymer were too small, then the advantages of the present invention would not be achieved.

Various other additives may be added to the dye receiving layer of the printing paper according to the present invention. For example, a fluorescent brightener (fluorescent dye) or a white pigment may be added to the dye receiving layer to increase the whiteness of the dye receiving layer for increasing the sharpness of an image formed thereon, impart a writing quality to the surface of the dye receiving layer, and prevent an image formed thereon by thermal transfer from being transferred again. The fluorescent brightener may be a commercially available product such as UVITEX OB manufactured by Ciba-Geigy. The white pigment may be of titanium oxide, zinc oxide, kaolin, clay, calcium carbonate, pulverized silica, or the like, which may be used alone or in combination.

The dye receiving layer may contain one or more of an ultraviolet absorber, a light stabilizer, an antioxidant, a surface modifier, etc. for increasing the light resistance of images formed thereon.

The dye receiving layer may also contain a parting agent for increasing its ability to be separated from the ink ribbon when an image has been formed on the dye receiving layer by thermal transfer. Such a parting agent may be solid wax such as polyethylene wax, amid wax, Teflon powder, or the like, or a surface-active agent such as of fluorine, phosphoric ester, or the like, or silicone oil, silicone wax of high melting point, or the like. It is preferable to use silicone oil, among these materials, for its ability to separate the dye receiving layer from the ink ribbon and its durability.

The silicone oil may be of an oil type or a reactive (curing) type which may selectively be used. The reactive (curing)-type silicone oil may be a cured product made by a reaction of alcohol-modified silicone oil and isocyanate, a cured product made by a reaction of epoxy-modified silicone oil (epoxy-polyether-modified silicone oil) and carboxy-modified silicone oil (carboxy polyether-modified silicone oil), a cured product made by a reaction of amino-modified silicone oil (amino-polyether.modified silicone oil) and carboxy-modified silicone oil (carboxy.polyethermodified silicone oil), or the like.

The dye receiving layer may further contain various curing agents for improving coating characteristics thereof. The curing agents may be an epoxy curing agent, an isocyanate curing agent, etc., and may preferably be non yellowing polyfunctional isocyanate compounds among others. Such polyfunctional isocyanate compounds may be, for example, fatty polyisocyanate such as hexamethylene diisocyanate (HDI), biuret, etc., and aromatic polyisocyanate such as toluene diisocyanate (TDI), xylene diisocyanate (XDI), etc., which may be used singly or in combination.

The dye receiving layer may also contain an antistatic agent for preventing static electric charges from being developed while the printing paper is being processed or running through a printer. The antistatic agent may be any of various surface-active agents including a cationic surface-active agent (quaternary ammonium salt, polyamine, or the like), an anionic surface-active agent (alkylbenzenesulfonate, alkylsulfuric ester sodium salt, or the like), an ampholytic surface-active agent, a nonionic surface-active agent, etc. The antistatic agent may be either contained in the dye receiving layer or coated on the surface of the dye receiving layer.

The above various additives may be used singly or in combination. However, the sum of added additives should preferably be equal to or less than 50 weight %, more preferably in the range from 0.5 to 30 weight %, of the copolymer of substituted or unsubstituted phenoxypolyethylene glycol (meth)acrylate and another monomer which is of a structure different therefrom.

The dye receiving layer may be formed by either uniformly mixing constituents thereof, if necessary together with a solvent, preparing a coating solution, and then applying the coating solution to a sheet-like base, or applying a hot-melt mixture of constituents thereof to a sheetlike base and curing the applied material.

The sheet-like base may comprise a sheet of paper such as wood-free paper, coated paper, synthetic paper, or the like, or any of various plastic sheets, or a composite sheet of paper and plastic.

A surface of the sheet-like base which is opposite to the dye receiving layer may be coated with a back coating layer of acrylic resin, silicone resin, or the like for allowing the printing paper to run smoothly in a printer and preventing two or more sheets of printing paper from being fed together in a printer.

Images may be formed on the printing paper in any of various processes. For example, an image may be recorded on the printing paper with an ink ribbon for sublimation-type thermal transfer recording by a commercially available video printer or the like for sublimation-type thermal transfer recording.

As described above, the printing paper according to the present invention has a dye receiving layer made of a copolymer of substituted or unsubstituted phenoxypolyethylene glycol (meth)acrylate and another monomer, the substituted or unsubstituted phenoxypolyethylene glycol (meth) acrylate having a proportion of 50 weight % or greater. The printing paper has high sensitivity with respect to images to be formed on the dye receiving layer by sublimation-type thermal transfer recording, and also high image retaining abilities including light resistance, shading and fading resistance, sebum resistance, and plasticizer resistance. The printing paper is also prevented from blocking, and is highly resistant to water.

EXAMPLES

The present invention will be described below with reference to examples thereof.

Inventive Examples 1~28, Comparative Examples 1, 2

Sheet-like bases were made of synthetic paper having a thickness of 150 μm (FPG-150 manufactured by Oji Yuka K.K.). Coating solutions for forming dye receiving layers, containing constituents given in Table 1 below, were prepared. Resin components of the dye receiving layers were composed of copolymers having compositions indicated in Tables 2 through 5 which are shown in FIGS. 2 through 5, respectively. The coating solutions were prepared such that the sum of solid elements of the components shown in Table 1 was 20% with respect to a solvent composed of a mixture of 2-butanone and toluene (1/1 volume ratio). The produced coating solutions were coated on the surfaces of the sheet-like bases by a wire bar such that the thickness of the coated layers would be in the range from 5 to 6 μm. The coated solutions were dried at 120° C. for 1 minute by a hot-air drier, and then aged at 50° C. for 48 hours, thereby producing sheets of printing paper.

TABLE 1

| Coating solution for forming dye receiving layers | (Parts by weight) |
|---|---|
| Resin components of dye receiving layers (Copolymers in Tables 1~5) | 100 |
| Silicone oil(*1) | 5 |
| Fluorescent brightener(*2) | 2 |
| Isocyanate Compound(*3) | 5 |

(*1)SF8427 manufactured by Toray Dow Corning Co., Ltd.
(*2)UVITEX manufactured by Ciba-Geigy Co., Ltd.
(*3)TAKENATE D110N manufactured by Takeda Chemical Industries, Ltd.

Evaluations:

The sheets of printing paper according to Inventive and Comparative Examples were evaluated for (i) transfer sensitivity, (ii) blocking tendency, (iii) light resistance, and (iv) sebum resistance as described below.

About 5 mg of each of the copolymers used was measured at a temperature increasing rate of 20° C./min. using DSC7 manufactured by Perkin-Elmer Inc. A value obtained in the second temperature scan were used as a glass transition temperature Tg.

The results are indicated in Tables 2~5.

(i) Transfer sensitivity:

using a sublimation-type thermal transfer ink ribbon (VPM-30STA manufactured by Sony K.K.), respective colors of yellow (Y), magenta (M), and cyan (C) were printed stepwise on the produced sheets of printing paper by a color video printer (CVP-G7 manufactured by Sony K.K.). The produced color images were measured for maximum density (OD Max) by a Macbeth reflective densitometer (TR-924). Depending on the measured values of maximum density, the sheets of printing paper were evaluated according to the following marks:

⊙: OD Max ≧2.5,

○: 2.5>OD Max ≧2.3,

Δ: 2.3>OD Max ≧2.0,

×: 2.0>OD Max.

(ii) Blocking tendency:

In the process of forming the sheets of printing paper, the coating solutions for forming dye receiving layers were applied to the surfaces of the sheet-like bases, and dried at 120° C. for 1 minute by a hot-air drier. Thereafter, two sheets of printing paper were superimposed on each other such that the dye receiving layer of one of the sheets of printing paper faced the surface of the sheet-like base of the other sheet of printing paper. A weight of 1 kg having a bottom area of 5 cm ×5 cm was placed on the superimposed sheets of printing paper, and they were left to stand at 50° C. for 48 hours. Subsequently, the superimposed sheets of printing paper were peeled off each other, and the surface of the dye receiving layer of the first sheet of printing paper was visually observed. Depending on the extent of a sheet-like base material sticking to the dye receiving layer, the sheet of printing paper was evaluated for blocking tendency as follows:

A: No sheet-like base material sticking to the dye receiving layer (no blocking), B: Partial sheet-like base material sticking to the dye receiving layer, C: Entire sheet-like base material sticking to the dye receiving layer.

(iii) Light resistance:

Images were formed on the sheets of printing paper in the same manner as the evaluation of (i) transfer sensitivity described above. The images were irradiated with 90000 Kj/m$^2$ at 30° C. and 65% RH by a xenon fading meter (manufactured by Suga Testing Machines). The images were then measured for optical densities before and after the irradiation by a Macbeth reflective densitometer (TR-924), and residual dye percentages were calculated according to the following equation:

Residual dye percentage (%)=(Optical density after irradiation/Optical density prior to irradiation)×100

Depending on the obtained residual dye percentages, the sheets of printing paper were evaluated according to the following marks:

⊙: residual dye percentage≧80%,

○: 80% >residual dye percentage≧70%,

Δ: 70% >residual dye percentage≧50%,

×: 50% >residual dye percentage.

(iv) Sebum resistance:

Images were formed on the sheets of printing paper in the same manner as the evaluation of (i) transfer sensitivity described above. The images were immersed in artificial sebum at 35° C. for 2 seconds, and then taken out, after which artificial sebum residues on the images were wiped out. The images were then measured for optical densities before and after they were treated by the artificial sebum in the manner as described above for (iii) light resistance, and residual dye percentages were determined. Depending on the obtained residual dye percentages, the sheets of printing paper were evaluated according to the following marks:

⊙: residual dye percentage≧80%,

○: 80% >residual dye percentage≧70%,

Δ: 70% >residual dye percentage≧50%,

×: 50% >residual dye percentage.

It can be seen from the results shown in Tables 2~5 that when a single polymer of phenoxyethyl methacrylate or phenoxyethoxyethyl methacrylate was used as a resin making up a dye receiving layer (Comparative Example 1), the sheet of printing paper had a high blocking tendency, whereas when a dye receiving layer was made of a copolymer of phenoxyethyl methacrylate or phenoxyethoxyethyl methacrylate and another monomer, with the proportion of phenoxyethyl methacrylate or phenoxyethoxyethyl methacrylate being equal to 60 weight % or greater (Inventive Examples 1~28), the sheets of printing paper had good results with respect to all items of evaluation including transfer sensitivity, blocking tendency, light resistance, and sebum resistance. It can also be understood that when a dye receiving layer was made of a copolymer of phenoxyethyl methacrylate and another monomer, with the proportion of phenoxyethyl methacrylate being 40 weight % (Comparative Example 2), the sheet of printing paper had very poor transfer sensitivity and light resistance.

The printing paper according to the present invention is high sensitive, and capable of forming images thereon which are given excellent image retaining abilities including light resistance, shading and fading resistance, sebum resistance, and plasticizer resistance.

Having described a preferred embodiment of the invention with reference to the accompanying drawings, it is to be understood that the invention is not limited to that precise embodiment and that various changes and modifications could be effected by one skilled in the art without departing from the spirit or scope of the invention as defined in the appended claims.

What is claimed is:

1. A printing sheet comprising:

a base sheet comprising paper or plastic having a surface; and a dye receiving layer disposed on said surface, said dye receiving layer comprising at least about 50% by weight, based on the weight of said dye receiving layer, of a copolymer having a glass transition temperature, $T_g$, of greater than or equal to 45° C. and having a weight average molecular weight of from about 50,000 to about 1,000,000, said copolymer comprising from about 50 to about 99% by weight of first monomeric units of at least one substituted or unsubstituted phenoxypolyethyleneglycol (meth)acrylate monomer and from about 1 to about 50% by weight of second monomeric units of at least one ethylenically-unsaturated copolymerizable monomer, based upon the weight of said copolymer.

2. printing sheet as defined in claim 1, werein said first monomeric units are phenoxyethyl methacrylate monomer units.

3. printing sheet as defined in claim 1, wherein said second monomeric units are selected from the group consisting of: styrene, methyl methacrylate, phenyl methacrylate, cyclohexyl methacrylate, isobornyl methacrylate, vinyl benzoate, hydroxyethyl methacrylate and mixtures of any of the foregoing monomers.

4. printing sheet as defined in claim 1, wherein said dye receiving layer further comprises at least one additive selected from the group consisting of: ultraviolet absorbers, light stabilizers, antioxidants, surface modifying agents, parting agents, curing agents, antistatic agents, plasticizers, fluorescent brighteners and pigments.

5. A printing sheet as defined in claim 1, wherein said base sheet further comprises a back coating layer comprising acrylic resin or silicone resin disposed on a surface of said base sheet opposite said dye receiving layer.

6. A thermal transfer recording system comprising:

an ink ribbon including an ink layer of a sublimation or thermal diffusion dye, a printing sheet having a dye receiving layer, and a printing head for heating the ink layer to provide imagewise transfer of the dye from the ink layer to the dye receiving layer, wherein said printing sheet comprises a base sheet having a surface; and a dye receiving layer disposed on said surface, said dye receiving layer comprising at least about 50% by weight, based on the weight of said dye receiving layer, of a copolymer having a glass transition temperature, $T_g$, of greater than or equal to 45° C. and having a weight average molecular weight of from about 50,000 to about 1,000,000, said copolymer comprising from about 50 to about 90% by weight of first monomeric units of at least one substituted or unsubstituted phenoxypolyethyleneglycol (meth) acrylate monomer and from about 1 to about 50% by weight of second monomeric units of at least one ethylinically-unsaturated copolymerizable monomer, based upon the weight of said copolymer.

7. A thermal transfer recording method comprising the steps of:

superposing an ink ribbon having an ink layer of a sublimation or thermal diffusion dye on a printing sheet having a dye receiving layer so that the ink layer is disposed adjacent the dye receiving layer; and heating the ink layer to provide imagewise transfer of the dye from the ink layer to the dye receiving layer, wherein the printing sheet comprises a base sheet having a surface; and a dye receiving layer disposed on said surface, said dye receiving layer comprising at least about 50% by weight, based on the weight of said dye receiving layer, of a copolymer having a glass transition temperature, $T_g$, of greater than or equal to 45° C. and having a weight average molecular weight of from about 50,000 to about 1,000,000, said copolymer comprising from about 50 to about 90% by weight of first monomeric units of at least one substituted or unsubstituted phenoxy-polyethyleneglycol (meth) acrylate monomer and from about 1 to about 50% by weight of second monomeric units of at least one ethylinically-unsaturated copolymerizable monomer, based upon the weight of said copolymer.

* * * * *